US005362175A

United States Patent [19]

Begin

[11] Patent Number: 5,362,175

[45] Date of Patent: Nov. 8, 1994

[54] MANHOLE HEAD ASSEMBLY HAVING A MANHOLE TOP RING AND METHOD OF USE OF THE SAME

[76] Inventor: Gaétan Begin, 1360 De Calais, Laval Quebec, Canada, H7G 4H5

[21] Appl. No.: 969,108

[22] Filed: Oct. 30, 1992

[51] Int. Cl.[5] ..... E02D 29/14

[52] U.S. Cl. ..... 404/26; 52/20

[58] Field of Search ..... 404/25, 26; 52/20

[56] References Cited

U.S. PATENT DOCUMENTS

| | | | |
|---|---|---|---|
| 2,977,864 | 4/1961 | Pullar | 94/22 |
| 3,308,727 | 3/1967 | Hurt | 94/34 |
| 3,611,889 | 10/1971 | Levinson | 94/34 |
| 3,858,998 | 1/1975 | Larsson et al. | 404/26 |
| 4,350,177 | 9/1982 | Firchau et al. | 137/370 |
| 4,475,845 | 10/1984 | Odill et al. | 404/25 |
| 4,593,714 | 6/1986 | Madden | 137/371 |
| 4,614,065 | 9/1986 | Papp | 52/20 |
| 4,759,656 | 7/1988 | Wilson | 404/26 |
| 4,998,387 | 3/1991 | Geiger | 52/20 |
| 5,030,030 | 7/1991 | Simmonds | 404/25 |
| 5,095,667 | 3/1992 | Ryan et al. | 52/20 |
| 5,122,008 | 6/1992 | Drews | 404/6 |
| 5,240,345 | 8/1993 | Gagas | 404/25 |
| 5,240,346 | 8/1993 | Yin | 404/25 |

FOREIGN PATENT DOCUMENTS

| | | | |
|---|---|---|---|
| 1270138 | 6/1990 | Canada . | |
| 2045219 | 12/1992 | Canada . | |
| 2209694 | 9/1973 | Germany . | |
| 3104303 | 8/1982 | Germany . | |
| 8604492 | 6/1986 | Germany . | |
| 8706371 | 6/1988 | Germany . | |
| 459909 | 7/1968 | Switzerland . | |
| 2247037 | 2/1992 | United Kingdom | 52/20 |

OTHER PUBLICATIONS

Regard circulaire-Advertising brochure of the firm VIBRAPIPE (No Date Given).

An advertising brochure of Domal Rubber Manhole Transition Collars and Risers (No Date Given).

An advertising brochure of Mueller Canada Inc. (in the French language) (No Date Given).

An advertising brochure of Mueller Canada Inc. (No Date Given).

An advertising brochure of Fonderie Laperle Ltée. (in the French language) (No Date Given).

An advertising brochure of Fonderie Laperle Ltée. (No Date Given).

*Primary Examiner*—Mark Rosenbaum
*Assistant Examiner*—John M. Husar
*Attorney, Agent, or Firm*—Merchant & Gould Smith, Edell, Welter & Schmidt

[57] ABSTRACT

The invention relates to a manhole head assembly of the type having a substantially vertical axis and being intended to be mounted on a conventional manhole member made of non-elastic material. The invention also relates to a manhole ring having an omni-directional upper part and to a method of use of said manhole ring.

23 Claims, 7 Drawing Sheets

MANHOLE HEAD ASSEMBLY HAVING A MANHOLE TOP RING AND METHOD OF USE OF THE SAME

FIELD OF THE INVENTION

The present invention relates to a manhole head assembly allowing to reduce vibrations that are communicated to the lower structure on which it rest, to thus contribute to prevent any premature wear of the same. The invention also relates to a manhole top ring having an adjustable upper part which can be oriented to have its top surface or a top surface of a manhole top ring mounted thereon, substantially flush with the surface of a roadway. The invention further relates to a method of use of said manhole top ring.

BRIEF DESCRIPTION OF THE PRIOR ART

It is known in the art to use manhole head assemblies that are made of resilient elastomeric material, such as rubber, to reduce vibrations communicated to the lower structure by vehicles on a roadway. However, prior manhole head assemblies are always freely mounted or stack on conventional risers which may be also made of elastic material such as rubber. More particularly, U.S. Pat. No. 5,030,030 relates to a pad which supports a utility access conduit in a roadway and permits relative moment between the conduit and the roadway without damaging a seal between them, said pad supporting the vehicles or traffic for a time comparable to a life of the roadway itself, without the occurrence of any dipping in the vicinity of the access conduit. This is accomplished with a rectangular block of rubber or similar compressible resilient elastomeric material provided with an opening passing through it that snugly engages the access conduit.

All prior art manhole head assemblies are subjected to be moved with the roadway when the ground is subjected to alternate cycles of freezing and thaw. However, such a free stack of structural elements and rings may be disconnected from each other to thus cause important damages.

Therefore, there is a strong need for a manhole head assembly allowing to reduce or damp vibrations originating from the traffic of vehicles on a roadway while avoiding any disconnection of the stack of elements and rings defining the head assembly to thus prevent damage to the same.

SUMMARY OF THE INVENTION

A first object of the invention is to provide a manhole head assembly whose the upper ring is made of resilient elastomeric material and is fastened by any appropriated means to a lower ring made of non-elastic material such as concrete. This lower ring may be conventionally mounted on existing manhole members (preferably spacers or rings).

Advantageously, this new manhole head assembly absorbs part of vibrations originating from the roadway, supports the load created by a traffic of vehicles, especially heavy traffic, and offers a high resistance to impacts and pre-maturated wear. Advantageously, this manhole head assembly shows an excellent resistance to weather conditions and contaminants that may occurred on a roadway. Preferably the aforesaid manhole head assembly is "shock proof" and can be used with existing installation or with bran new installation.

More particularly, the present invention provide a solution to several existing problems with respect to roadway, such as paving repairs of roadways around manholes. Indeed, deteriorations noted around said manholes generated years after years repetitive maintenance problems that are very expensive.

The invention also relates to a manhole head assembly that can absorb impacts generated by vehicles on said roadway, prevent water infiltrations, absorb eventual packing of the surrounding ground, reduce maintenance costs, avoid noise generated by impacts of the cover (e.g. a lid or a grid) against its corresponding upper ring (especially because a high degree of perfection in the shape for the groove where the cover is positioned).

The invention also relates to a manhole head assembly provided with means allowing to fasten its constitutive rings together and prevent them to be disconnected by the action of freezing-thaw cycles.

Furthermore, the invention relates to a manhole head assembly provided with a bevelled edge in its upper part in order to prevent deterioration created by the blade of a snow-plow.

The invention also relates to a manhole head assembly having a great structural flexibility and especially when rubber material is used, waterproof characteristics at the roadway level.

The invention also relates to a manhole head assembly which is further provided with optional spacer rings that can be easily, quickly and efficiently installed with usual fastening means such as screws or nut-bolts assemblies. These spacer rings may be either concrete flat rings, or resilient elastomeric flat rings. Preferably, said spacer rings are rubber flat rings.

The invention also relates to a manhole head assembly where rubber rings are made with rubber material recycled from old tires according to methods well known in the art.

The invention also relates to a manhole ring of the type provided with an upper part contained in a plane that can be oriented to be substantially parallel with the surface of the roadway. One or several rings may be stacked and fastened on the upper part of this manhole top ring. However, it is preferable to have this upper part substantially flush with the surface of the roadway.

Finally, the invention also relates to method for adjusting the upper part of the aforesaid manhole top ring substantially parallel and preferably flush with the surface of a roadway.

According to a first aspect, the invention relates to a manhole head assembly of this type having a substantially vertical axis and being intended to be mounted on an uppermost conventional manhole member (which may define a ring) made of non-elastic material, said head assembly comprising a stack of rings substantially co-axial with said vertical axis, whose:

- a lower ring made of non-elastic material and provided with a lower and an upper parts, the lower part being shaped to be stacked on an upper part of the aforesaid conventional manhole member;
- one or several upper rings made of elastic material and each provided with a lower and an upper parts, the lower part of each of said upper rings being shaped to be stacked either on the upper part of the lower ring, or on the upper part of another upper ring positioned underneath;
- means for fastening the lower part of one upper ring against the upper part of the lower ring;

means for fastening the lower part of any of said(s) other(s) upper ring(s) with the upper part of an upper ring positioned underneath, when there is more than one upper ring;

a manhole cover provided with a lower, lateral(s) and an upper parts; and means positioned in the upper part of the upper ring located at the top of the stack for receiving the lower and lateral(s) part(s) of the manhole cover while positioning the upper part of said manhole cover substantially flush with the upper part of this uppermost upper ring.

According to another aspect, the invention relates to a manhole ring of the type provided with an inner wall and an upper and a lower parts, and intended to be mounted on a conventional manhole member, the lower part being sized and shaped to be stacked on the upper part of a corresponding manhole member, the upper part of the ring being preferably provided with an inner wall and with a groove appearing simultaneously in the upper part and the inner wall of said ring, this groove being intended to define;

when associated with lateral(s) and lower parts of a manhole cover, means for receiving and positioning said manhole cover;

when associated with a sleeve (preferably an annular sleeve) projecting from the lower part of a neighboring upper ring positioned above, means for the co-axial positioning of neighboring rings; said ring having its upper part substantially contained in a plane and provided with means allowing to move said upper part to set this plane at an angle (preferably an acute angle) with respect to a plane orthogonal with the aforesaid vertical axis, and means to lock that plane at such an angle.

According to another aspect, the invention relates to a method for adjusting the upper part of a manhole ring as defined hereinbefore, wherein the upper part is divided in an upper and a lower portions, the upper portion having a sector of spherical surface, the lower portion having a sector of spherical surface, and the sector of spherical surface of the upper portion being slidable on the sector of spherical surface of the lower portion until the plane containing the upper part of the upper portion, is substantially parallel with the surface of a roadway, and then both portions of the manhole ring are locked together with appropriated means.

BRIEF DESCRIPTION OF THE DRAWINGS

The present invention will be better understood with reference with the following non-restrictive description of preferred embodiments thereof, taken in connection with the following drawings wherein.

DESCRIPTION OF PREFERRED EMBODIMENTS

Figure 1:
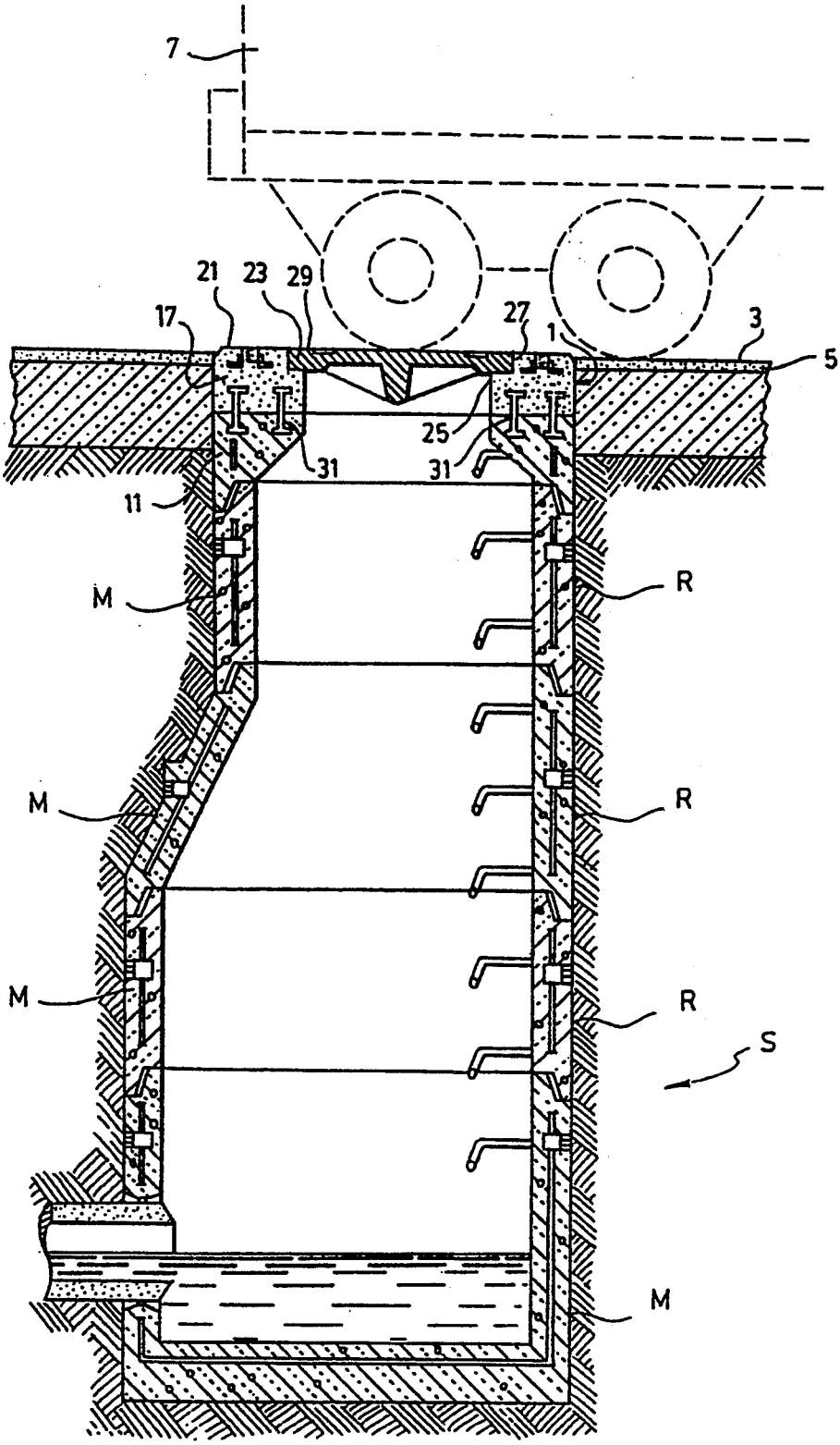
FIG. 1 is a cross sectional view of a part of a sewage system provided with a manhole conduit comprising a manhole head assembly according to the invention.
Figure 2:
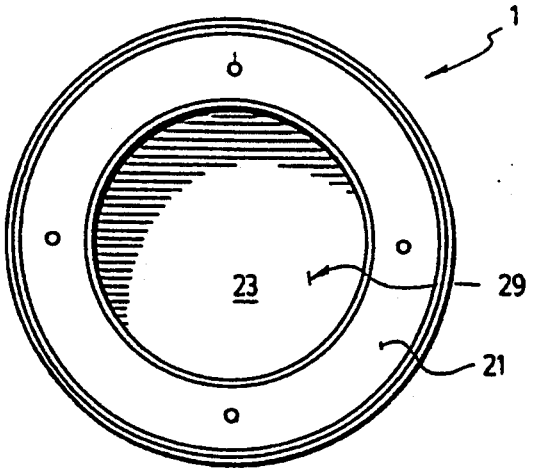
FIG. 2 is a top plane view of a manhole head assembly according to the invention with a cover.
Figure 3:
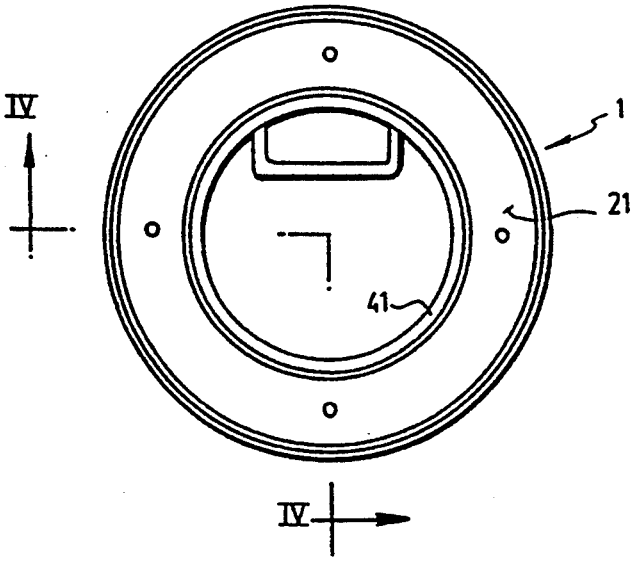
FIG. 3 is a top plane view of a manhole head assembly according the invention without a cover.

With reference to FIG. 1 there is represented a part of a sewer system "S" provided with a manhole conduit comprising conventional members "M" (which may be rings "R"). The upper part of the manhole head assembly 1 appears substantially flush with the surface 3 of a roadway 5. Vehicle such as a vehicle 7, are intended to move on said roadway 5.

Figure 4:
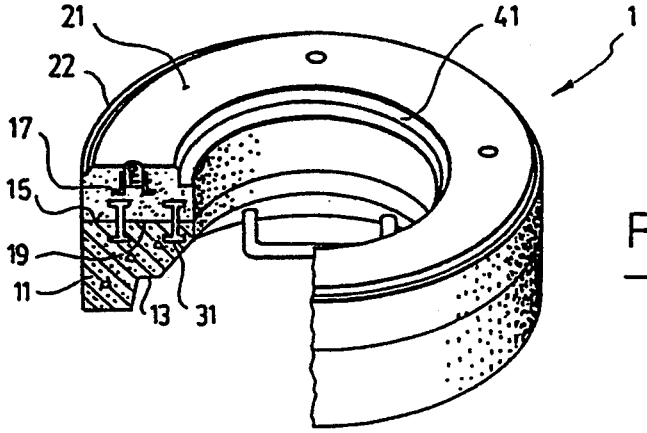
FIG. 4 is a perspective view according to lines IV—IV of the manhole/head assembly represented in FIG. 3.

According to a preferred aspect of the present invention, there is represented in FIGS. 1 to 4 a manhole head assembly 1 having a substantially vertical axis and mounted on conventional manhole members "M" (including members such as rings "R") made of non-elastic material (e.g. concrete). This head assembly 1 comprises a stack of rings substantially co-axial with said vertical axis, whose:

a lower ring 11 made of non-elastic material (preferably made of concrete) and provided with a lower and an upper parts 13,15, the lower part 13 being shaped to be stacked on an upper part of the aforesaid conventional manhole member "M" which may be a ring "R";

an upper ring 17, made of resilient elastomeric material (preferably made of rubber) and provided with a lower and an upper parts 19,21, the lower part 19 of the ring 17 being shaped to be stacked on the upper part 15 of the lower ring 11 (preferably, as illustrated in FIG. 4, the upper part 15 and the lower part 19 may be radial surfaces)

means for fastening the lower part 19 of the upper ring 17 against the upper part 15 of the lower ring 11;

a manhole cover 23 provided with a lower, a lateral and an upper parts 25,27,29; and means positioned in the upper part 21 of the upper ring 17 for receiving the lower and lateral parts 25,27 of the manhole cover 23 while positioning the upper part 29 substantially flush with the upper part 21 of the upper ring 17.

Preferably, as means for fastening the upper and lower rings 17,11 together there is provided at least one tie-rod 31, preferably two annular tie-rods 31, having opposite ends, each end being provided with at least one shoulder, one part of each tie-rod being positioned with its corresponding shoulder(s) in the elastomeric material (e.g. a rubber), the remaining part of each tie-rod being positioned with its corresponding shoulder in the non-elastic material (e.g. a concrete).

Preferably, for embodying an assembly 1, a part of the tie-rod 31 may be positioned in the mass of rubber before the vulcanization of said rubber and held in place during the vulcanization of said rubber. Then, the remaining part of the tie-rod 31 is dipped in uncured concrete contained in a mould and held there until the concrete is hardened.

Advantageously, the upper ring 17 is provided with an inner wall 39 and a groove 41 is appearing simultaneously in the inner wall 39 and the upper part 21.

Advantageously, an upper edge 22 of the upper ring 21 is bevelled.

In order to proceed with the installation of a head assembly 1 as illustrated in FIGS. 1 to 4, the following steps may be preferably involved:

The lower part 13 of the lower ring 11 is stacked freely on the upper part of a conventional manhole member (such as a ring "R").

If the upper part 21 of the upper ring 17 having its lower part against the upper part 15 of the lower ring 11, is substantially flush and parallel with the surface of the roadway 3. Of course, if the upper part 21 of the upper ring 17 was not substantially flush with the surface of the roadway, one or several upper rings 17 or spacers could be stacked and fastened on said upper part 21. Then, lower and lateral parts 25,27 of the cover 23 are positioned in the groove 41 with the upper part 29 of said cover 23 substantially flush with the upper part 21 of the upper ring 17.

Advantageously, when the surface of the roadway 5 is substantially flush with the upper part 21 of an upper ring 17 or the upper part of a spacer, a pavement may be applied around the head assembly subsequently to the installation of the head assembly 1, according to method well known in the art.

Preferably, when the upper part 21 of the upper ring 17 is provided with a bevelled edge 22, the surface of the pavement defining the roadway may be advantageously positioned just below the level of this edge 22

In use, when a vehicle 7 hits the upper part 21 and the cover 23 of the assembly 1, then sounds generated by the cover 23 in the groove 41 is reduced, and vibrations communicated to lower rings or members are also reduced.

Figure 5:
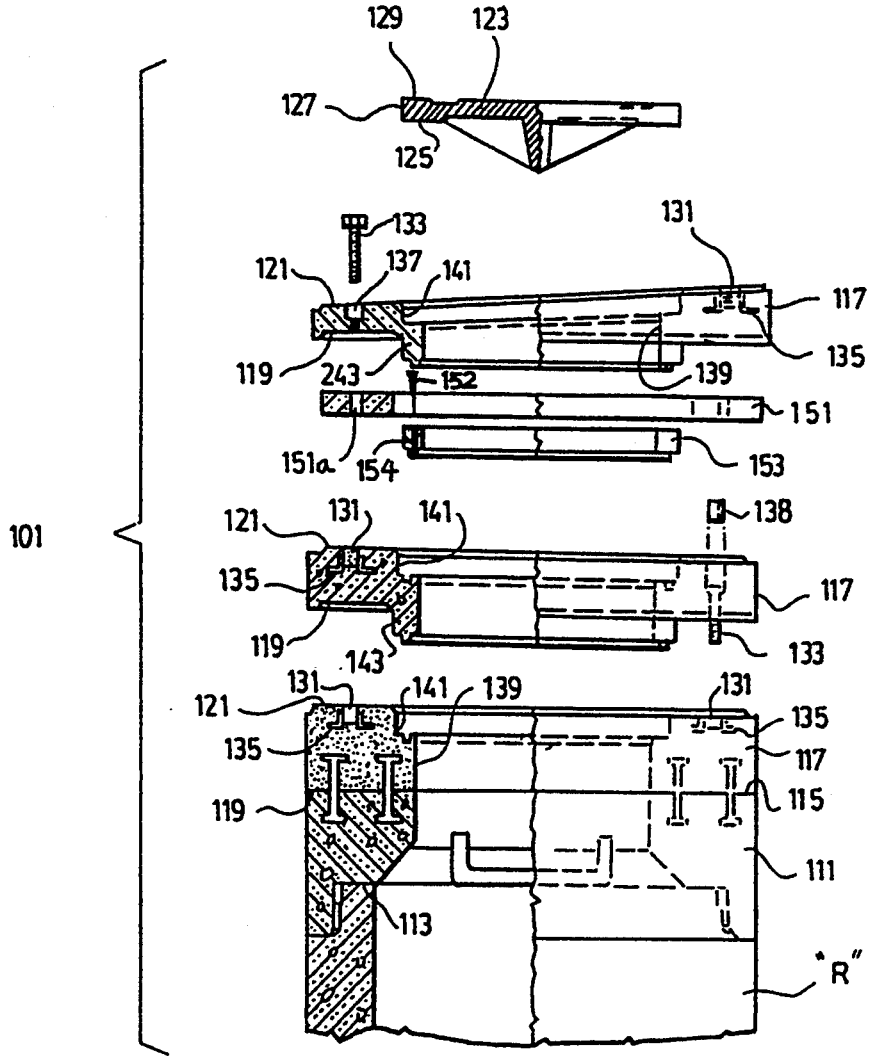
FIG. 5 is an exploded cross sectional view of a first variant of a manhole head assembly according to the invention.
Figure 7:
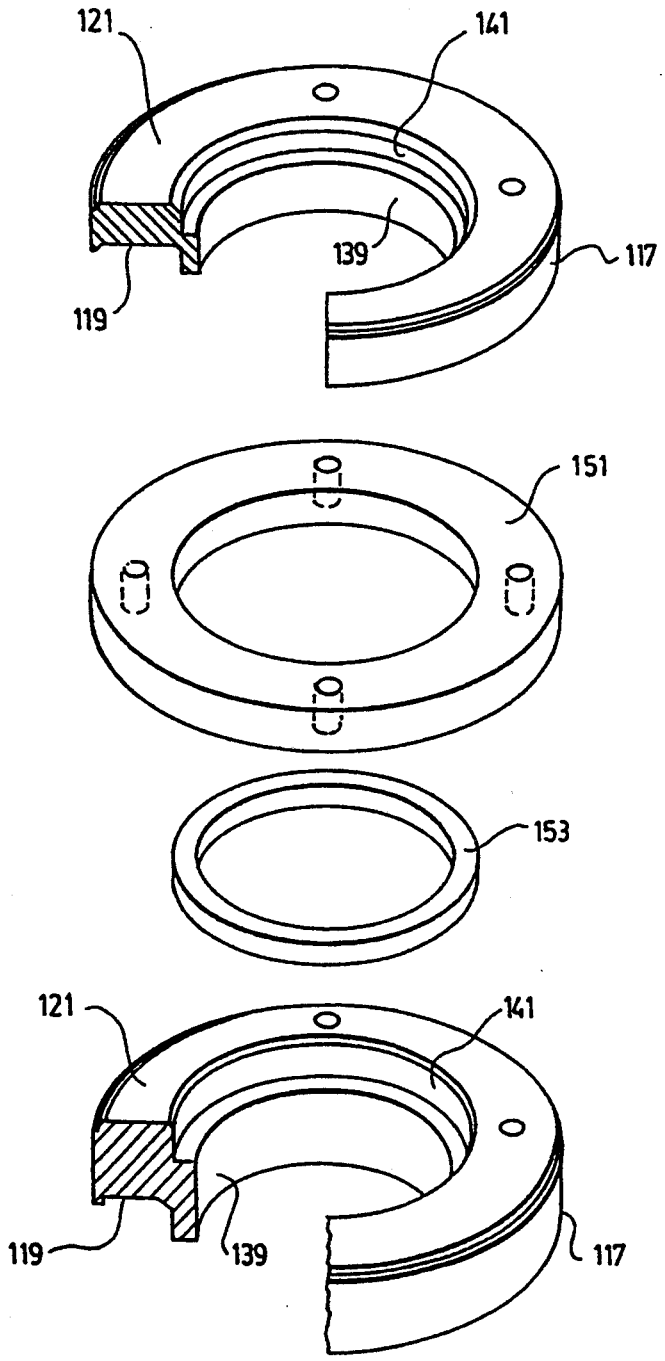
FIG. 7 is a partial exploded perspective view of the first variant of manhole head assembly.

Referring to FIGS. 5 and 7, there is represented a particularly preferred variant of the present invention, that is, a manhole head assembly 101 which will be described hereinafter. This manhole head assembly 101 has a substantially vertical axis and is mounted on a conventional manhole member (which may be a ring "R") made of non-elastic material (such as concrete). This head assembly 101 comprises a stack of rings substantially co-axial with said vertical axis, whose:

a lower ring 111 made of non-elastic material, (preferably made of concrete), and provided with a lower and an upper parts 113,115, the lower part 113 being shaped to be stacked on an upper part of conventional manhole member (which may be a ring "R");

several upper rings 117 made of resilient elastomeric material (preferably made of rubber) and each provided with a lower and an upper parts 119, 121, the lower part 119 of one of said rings 117 being shaped to be stacked on the upper part of the lower ring 111, the lower part of the other(s) of said(s) upper ring(s) 117 being shaped to be stacked on the upper part of a neighboring upper ring 117 positioned underneath (preferably, said lower part defines a circular groove ant said upper part defines a circular protuberance adapted to engage a corresponding circular groove);

means for fastening the lower part 119 of one upper ring 117 against the upper part of the lower ring 111;

means for fastening the lower part of said(s) other(s) upper ring(s) 117 with the upper part of a neighboring upper ring 117 positioned underneath;

a manhole cover 123 provided with a lower, a lateral and an upper parts 125,127,129; and means positioned in the upper part 121 of the upper ring 117 located at the top of the stack for receiving the lower and lateral parts 125,127 of the manhole cover 123 while positioning the upper part 121 of said manhole cover 123 substantially flush with the upper part 121 of this upper ring 117.

The lower ring 111 and an upper ring 117 are fastened together in the same way than the lower ring 11 is fastened with an upper ring 17, and more particularly with tie-rod(s). Numeral references used in FIGS. 1 to 4 have been incremented by one hundred in FIGS. 5 and 7.

Advantageously, between at least one pair and preferably between each pair of neighboring upper rings 117, means may be further provided for the co-axial positioning of said neighboring rings along said substantially vertical axis.

Preferably, at least one (and preferably all) of said upper ring(s) 117 is provided with an inner wall 139 and with a groove 141 appearing simultaneously in the upper part 121 and the inner wall 139 of said ring, this groove 141 being intended to define:

when associated with said lateral and lower parts 125,127 of the manhole cover 123, when said upper ring 117 is at the top of the stack defining the manhole head 101, said means for receiving and positioning the manhole cover 123, when associated with an annular sleeve 143 concentrically projecting from the lower part 119 of a corresponding upper ring 117, said sleeve 143 being sized and shaped to fit in the above mentioned groove 141, said means for the axial positioning of a neighboring upper ring 117.

Preferably, as illustrated in the variant of FIGS. 5 and 7, between two neighboring upper rings 117, there may be further provided a first spacer ring 151 between the upper part 121 of one upper ring 117 and the lower part 119 of another upper ring 117, and a second spacer ring 153 between the upper part of the groove 141 and the lower part of the sleeve 143, said spacers 151,153 being advantageously made of resilient elastomeric material (such as rubber).

Preferably, as still illustrated in the variant of FIGS. 5 and 7, the upper ring 117, at the top of the stack, may be provided with a top part substantially contained in a plane that forms an angle with respect to a plane orthogonal with the substantially vertical axis of the manhole head 101 (see FIGS. 5 and 7). Such a characteristic is advantageous in order to put the upper part of the upper ring 117 at the top of the stack substantially flush and parallel with the surface of the roadway (i.e. in case where a curve or a hill is encountered).

Advantageously, an upper edge 122 of at least one, preferably all, upper rings 217 may be bevelled.

Preferably, as said means for fastening the lower part 119 of an upper ring 117 with the upper part 121 of a corresponding upper ring 117 there is provided one or several nut-bolt assemblies, each nut-bolt assembly comprising a nut 131 and a bolt 133, the nut 131 being provided with one or several shoulder(s) 135 positioned in the rubber of the upper ring 117 positioned underneath so as to have one end thereof substantially flush with the upper part 121 of said upper ring 117, the bolt 133 being provided with a head defining a shoulder and housed in a corresponding bore 137 provided across the upper ring 117 that is positioned above, said bore(s) 137 being provided with a shoulder adapted to be engaged by the shoulder of the bolt 133 when this bolt 133 is engaged with its corresponding nut 131 to thus press the lower part 119 of one upper ring 117 positioned above against the upper part 121 of the upper ring 117 positioned underneath. Optionally, a plug member 138, preferably made of rubber, may be inserted in the bore where a bolt 133 is positioned to seal it.

Preferably, each bolt 133 may be engaged with its corresponding nut 131 under the action of a mere screwdriver engaging the head, of the bolt.

Preferably, each upper ring is obtained by vulcanization of a rubber in a mould, and each nut 131 may be positioned in the mass of rubber before the vulcanization of said rubber, and held in place during the vulcanization of said rubber.

In order to proceed with the installation of a head assembly 101 as illustrated in FIGS. 5 and 7, the following steps may be preferably involved:

The lower part 113 of the lower ring 111 is stacked freely on the upper part of a conventional manhole member (such as a ring "R").

The lower part 119 of a second upper ring 117 is stacked on the upper part 121 of a first upper ring 117 having a lower part against the upper part 115 of the lower ring 111. Then bolts 133 (preferably 4 bolts) are each engaged with a corresponding nut 131 with a screwdriver engaging the head of said bolts, to thus press parts 119 and 121 one against the other. Optionally, a plug 138 may be introduced in each bore 137 to seal it. Advantageously, each plug 138 may be introduced in a corresponding bore like a dowel with a hammer.

The lower part of a first and a second spacers 151 and 153 may be respectively stacked on the upper part of the second upper ring 117 and on the bottom of the groove 141 of the second upper ring 117. The spacer 153 may be fastened in the bottom of the groove 141 with screws 152 as illustrated in FIG. 5. Preferably, each screw 152 engages a corresponding bore 154 provided in the spacer 153, and then is screwed in the bottom of the groove 141 until the lower part of this spacer be pressed against the bottom of said groove.

The lower part 119 of a third upper ring 117, which is provided with an upper part contained in a plane that forms an angle with respect to a plane orthogonal with the substantially vertical axis of the manhole head 101, is stacked over the first and second spacers 151 and 153.

Then bolts 133 are each engaged with a corresponding nut 131 with a screwdriver engaging the head of said bolts, to thus press parts 119 and 121 one against the other, with spacers 151 and 153 therebetween. Preferably, each bolt 133 passes through a corresponding opening 151*a* provided in the spacer 151. Optionally, a plug 138 may be introduced in each bore 137 to seal it. Advantageously, each plug 138 may be introduced in a corresponding bore like a dowel with a hammer.

The lower and lateral parts 125 and 127 of the cover 123 are positioned in the groove 141 of the third upper ring 117, with the upper part 129 of the cover 123 substantially flush with the upper part 121 of the third upper ring 117. This upper part 121 of this third upper ring 117 may be substantially flush with the surface of a roadway.

Of course, if necessary to reach the surface of the roadway, additional spacers 151 and 153 and/or upper ring(s) 117 may be stacked and fastened on the upper part 121 of the third upper ring 117.

Advantageously, when the surface of a roadway is substantially flush with the upper part 121 of an upper ring 117 or the upper part of a spacer, a pavement may be applied around the head assembly subsequently to the installation of the head assembly 101, according to method well known in the art.

Preferably, when the upper part 121 of the upper ring 117 is provided with a bevelled edge 122, the surface of the pavement defining the roadway may be advantageously positioned just below the level of this edge 122

In use, when a vehicle hits the upper part 121 and the cover 123 of the assembly 101, then sounds generated by the cover 123 in the groove 141 is reduced, and vibrations communicated to lower rings or members are also reduced.

Figure 6:
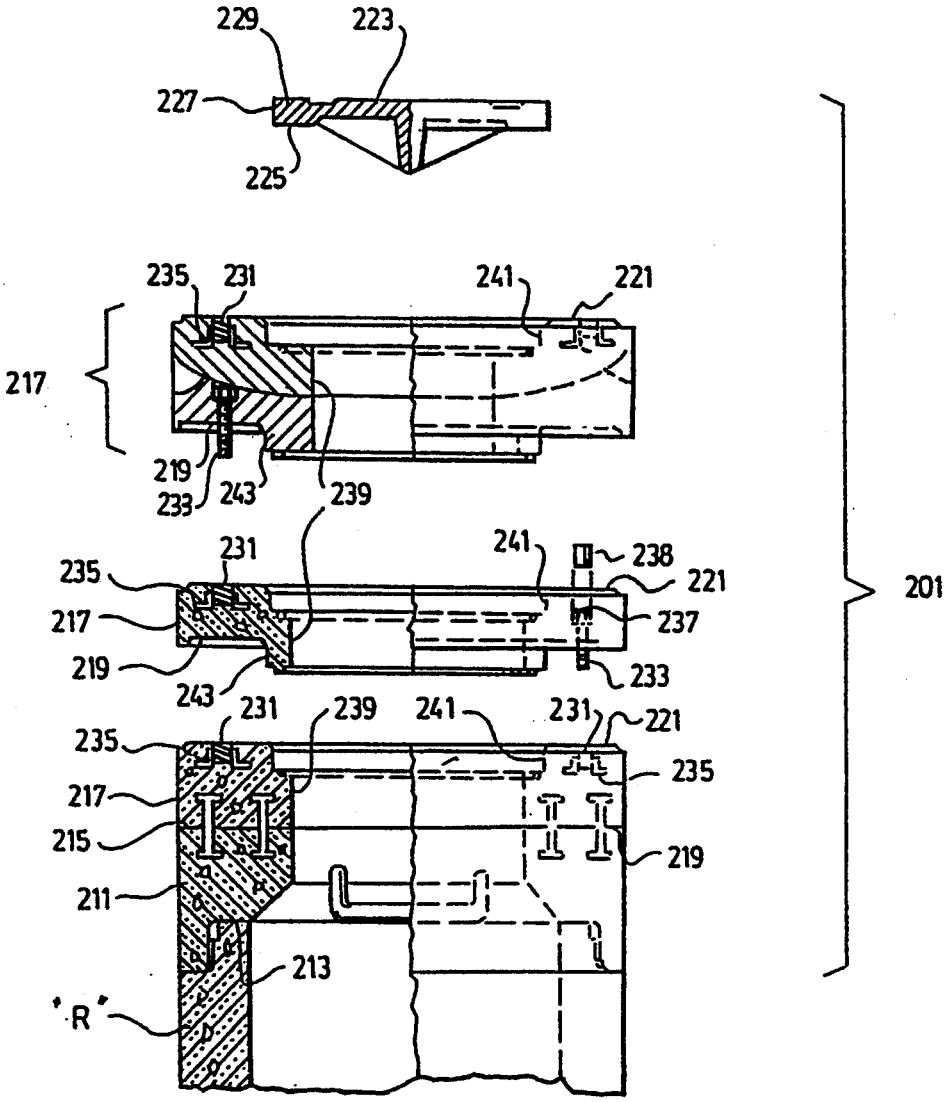
FIG. 6 exploded cross sectional view of a second variant of a manhole head assembly according to the invention.
Figure 8A:
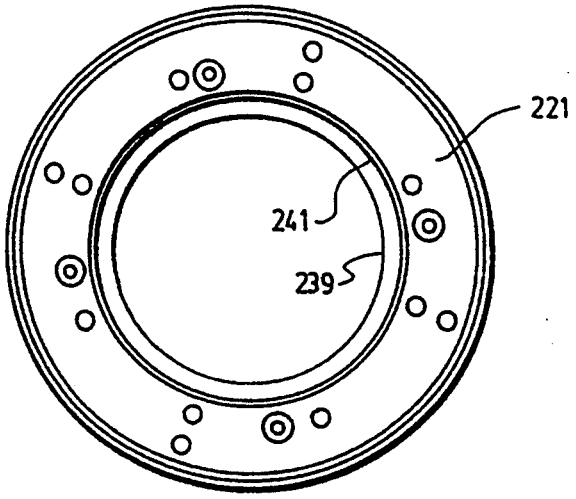
FIGS. 8, 8*a* is partial exploded perspective view of the second variant of manhole head assembly.
Figure 8:
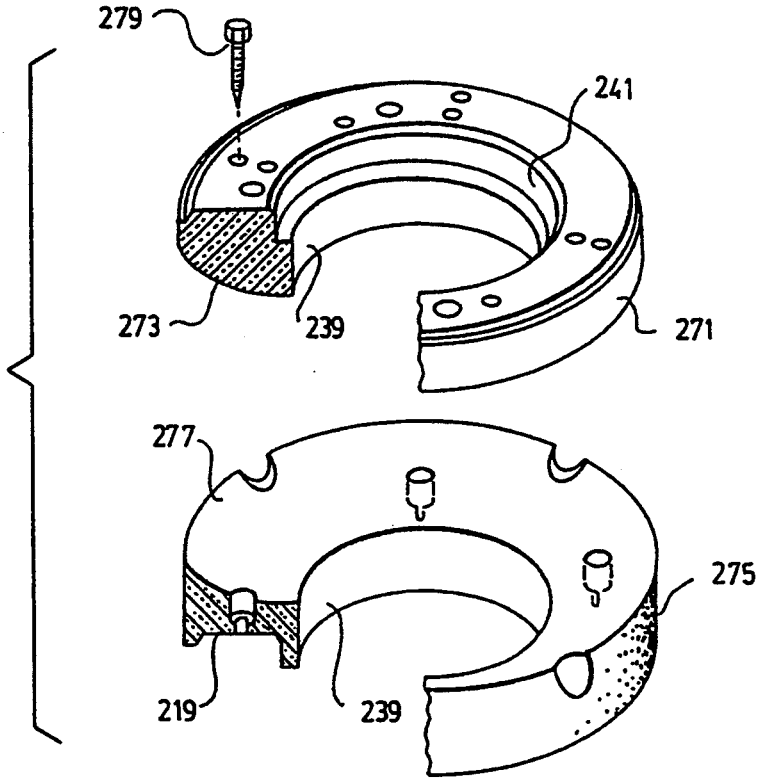

Referring to FIGS. 6 and 8, there is represented another particularly preferred variant of the present invention, that is, a manhole head assembly 201 which will be described hereinafter. This manhole head assembly 201 has a substantially vertical axis and is mounted on a conventional manhole member (which may be a ring "R") made of non-elastic material (such as concrete). This head assembly 201 comprises a stack of rings substantially co-axial with said vertical axis, whose:

a lower ring 211 made of non-elastic material, (preferably made of concrete), and provided with a lower and an upper parts 213,215, the lower part 213 being shaped to be stacked on an upper part of conventional manhole member (which may be a ring "R");

several upper rings 217 made of resilient elastomeric material (preferably made of rubber) and each provided with a lower and an upper parts 219, 221, the lower part 219 of one of said rings 217 being shaped to be stacked on the upper part of the lower ring 211, the lower part of the other(s) of said(s) upper ring(s) 217 being shaped to be stacked on the upper part of a neighboring upper ring 217 positioned underneath (preferably, the lower part defines a circular groove and the upper part defines a circular protuberance adapted to engage a corresponding circular groove);

means for fastening the lower part 219 of one upper ring 217 against the upper part of the lower ring 211;

means for fastening the lower part of said(s) other(s) upper ring(s) 217 with the upper part of a neighboring upper ring 217 positioned underneath;

a manhole cover 223 provided with a lower, a lateral and an upper parts 225,227,229; and means positioned in the upper part 221 of the upper ring 217 located at the top of the stack for receiving the lower and lateral parts 225,227 of the manhole cover 223 while positioning the upper part 221 of said manhole cover 223 substantially flush with the upper part 221 of this upper ring 217.

The lower ring 211 and an upper ring 217 are fastened together in the same way than the lower ring 11 is fastened with an upper ring 17, and more particularly with tie-rod(s). Numeral references used in FIGS. 1 to 4 have been incremented by two hundreds in FIGS. 6 and 8.

Advantageously, between at least one pair and preferably between each pair of neighboring upper rings 217, means may be further provided for the co-axial positioning of said neighboring rings along said substantially vertical axis.

Preferably, at least one (and preferably all) of said upper ring(s) 217 is provided with an inner wall 239 and with a groove 241 appearing simultaneously in the upper part 221 and the inner wall 239 of said ring, this groove 241 being intended to define:

when associated with said lateral and lower parts 225,227 of the manhole cover 223, when said upper ring 217 is at the top of the stack defining the manhole head 201, said means for receiving and positioning the manhole cover 223, when associated with an annular sleeve 243 concentrically projecting from the lower part 219 of a corresponding upper ring 217, said sleeve 243 being sized and shaped to fit in the above mentioned groove 241, said means for the axial positioning of a neighboring upper ring 217.

Preferably, as illustrated in the variant of FIGS. 6 and 8, the upper ring 217, which may be, as illustrated, at the top of the stack, may have its upper part substantially contained in a plane and may be provided with means allowing to move that plane at an angle with respect to a plane orthogonal with the substantially vertical axis of the manhole head 201, and provided with means to lock that plane at such an angle.

Preferably, means for moving the plane in which the upper part 221 of the upper ring 217 is contained, may consist of:

an upper portion 271 having an upper part which corresponds to the upper part 221 of the upper ring 217, and a lower part 273 defining a sector of spherical surface, a lower portion 275 having a lower part which corresponds to the lower part 219 of the upper ring 217, and an upper part 277 defining a sector of spherical surface, both sectors of spherical surfaces having similar radius of curvature to allow one surface to slide freely on the other surface.

Preferably, the sector of spherical surface of the upper part 271 is convex and the sector of spherical surface of the lower part 275 is concave.

Preferably, means for locking the plane in which the upper part 221 of the upper part 271 is contained, at a determined angle with respect to a plane orthogonal with the vertical axis of the manhole head, may consist of one or several screws 279 (only one illustrated) each provided with a shoulder and adapted to engage a corresponding shoulder provided in a bore in said upper part 221 so as to press the upper part 271 against the lower part 275 when said screw is engaged in said bore and driven in the rubber defining the lower part 275. Such a characteristic is advantageous to have the upper part of the upper ring 217 at the top of the stack substantially flush and parallel with the surface of the roadway (e.g. in case where a curve or a hill is encountered)

Preferably, as said means for fastening the lower part 219 of an upper ring 217 with the upper part 221 of a corresponding upper ring 217 there is provided one or several nut-bolt assemblies, each nut-bolt assembly comprising a nut 231 and a bolt 233, the nut 231 being provided with one or several shoulder(s) 235 positioned in the rubber of the upper ring 217 positioned underneath so as to have one end thereof substantially flush with the upper part 221 of said upper ring 217, the bolt 233 being provided with a head defining a shoulder and housed in a corresponding bore 237 provided across the upper ring 217 that is positioned above, said bore(s) 237 being provided with a shoulder adapted to be engaged by the shoulder of the bolt 237 when this bolt 237 is engaged with its corresponding nut 231 to thus press the lower part 219 of one upper ring 217 positioned above against the upper part 221 of the upper ring 217 positioned underneath. Optionally, a plug member 238, preferably made of rubber, may be inserted in the bore where a bolt 233 is positioned to seal it.

Preferably, each bolt 233 may be engaged with its corresponding nut 231 by the action of a mere screwdriver engaging the head of the bolt.

Preferably, each upper ring and upper and lower portions are obtained by vulcanization in a mould, and each nut 231 may be positioned in the mass of rubber before the vulcanization of said rubber, and held in place during the vulcanization of said rubber.

In order to proceed with the installation of a head assembly 201 as illustrated in FIGS. 6 and 8, the following steps may be preferably involved:

The lower part 213 of the lower ring 211 is stacked freely on the upper part of a conventional manhole member (such as a ring "R") .

The lower part 219 of a second upper ring 217 is stacked on the upper part 221 of a first upper ring 217 having a lower part against the upper part 215 of the lower ring 211. Then bolts 233 (preferably 4 bolts) are each engaged with a corresponding nut 231 with a screwdriver engaging the head of said bolts, to thus press parts 219 and 221 one against the other. Optionally, a plug 238 may be introduced in each bore 237 to seal it. Advantageously, each plug 238 may be introduced in a corresponding bore like a dowel with a hammer.

The lower part 219 of the lower portion 275 is stacked over the upper part 221 of the second upper ring 217. Then bolts 233 (preferably 4 bolts) are each engaged with a corresponding nut 231 with a screwdriver engaging the head of said bolts, to thus press parts 219 and 221 one against the other. Optionally, a plug 238 may be introduced in each bore 237 to seal it. Advantageously, each plug 238 may be introduced in a corresponding bore like a dowel with a hammer.

The upper portion 271 is stacked over the lower portion 275, and the surface of the lower part 273 is slid over the surface of the upper part 277 until the upper part 221 of the third upper ring 217 is substantially flush and parallel with the surface of a roadway.

Of course, if necessary to reach the surface of the roadway, additional spacers 151 and 153 and/or upper ring 217 may be stacked and fastened on the third upper ring 217.

Advantageously, when the surface of the roadway is substantially flush with the upper part 221 of an upper ring 217 or the upper part of a spacer, a pavement may be applied around the head assembly subsequently to the installation of the head assembly 201, according to method well known in the art.

Preferably, when the upper part 221 of the upper ring 217 is provided with a bevelled edge 222, the surface of the pavement defining the roadway may be advantageously positioned just below the level of this edge 222.

The invention also relates to a manhole ring, as illustrated in FIG. 8, of the type provided with an inner wall 239 and an upper and a lower parts 221, 219, said ring 217 being intended to be mounted on a neighboring ring 217 positioned underneath (or being intended to be mounted on a neighboring member "M" (which may be a ring "R") as illustrated in FIG. 1). This manhole ring 217 has its lower part 219 sized and shaped to be stacked on the upper part 221 of a neighboring upper ring 217 (or on the upper part of a member "M" (which may be a ring "R" as illustrated in FIG. 1).

The upper part 221 of the manhole ring 217 is provided with an inner wall 239 and with a groove 241 appearing simultaneously in the upper part and the inner wall 239 of said ring 217, this groove 241 being intended to define:

when associated with lateral and lower parts 227,225 of a manhole cover 223, means for receiving and positioning said manhole cover 223;

when associated with an annular sleeve 243 projecting from the lower part 219 of a neighboring upper ring 217 positioned above, means for the co-axial positioning of neighboring rings 217.

The ring 217 has its upper part 221 substantially contained in a plane and provided with means allowing to move said upper part 221 so as to set that plane at an angle with respect to a plane orthogonal with the substantially vertical axis of the manhole ring 217. Means are also provided to lock that plane at such an angle.

Preferably, means for moving the plane in which the upper part 221 of the upper ring 217 is contained, may consist of:

an upper portion 271 having an upper part which corresponds to the upper part 221 of the upper ring 217, and a lower part 273, defining a sector of spherical surface, a lower portion 275, having a lower part which corresponds to the lower part 219 of the upper ring 217 and an upper part 277 defining a sector of spherical surface, both sectors of spherical surfaces having similar radius of curvature to allow one surface to slide freely on the other surface.

Preferably, the sector of spherical surface of the upper part 221 is convex and the sector of spherical surface of the lower part 275 is concave.

Preferably, means for locking the plane containing the upper part 221 of the upper part 271 at a determined acute angle with respect to a plane orthogonal with the vertical axis of the manhole top ring 217, consist of one or several screws 279 each provided with a shoulder adapted to be engaged by the shoulder of a bore provided in the upper part 271 so as to press the upper part 271 against the lower part 275 when said screw is driven in the lower part 275.

Figure 9:
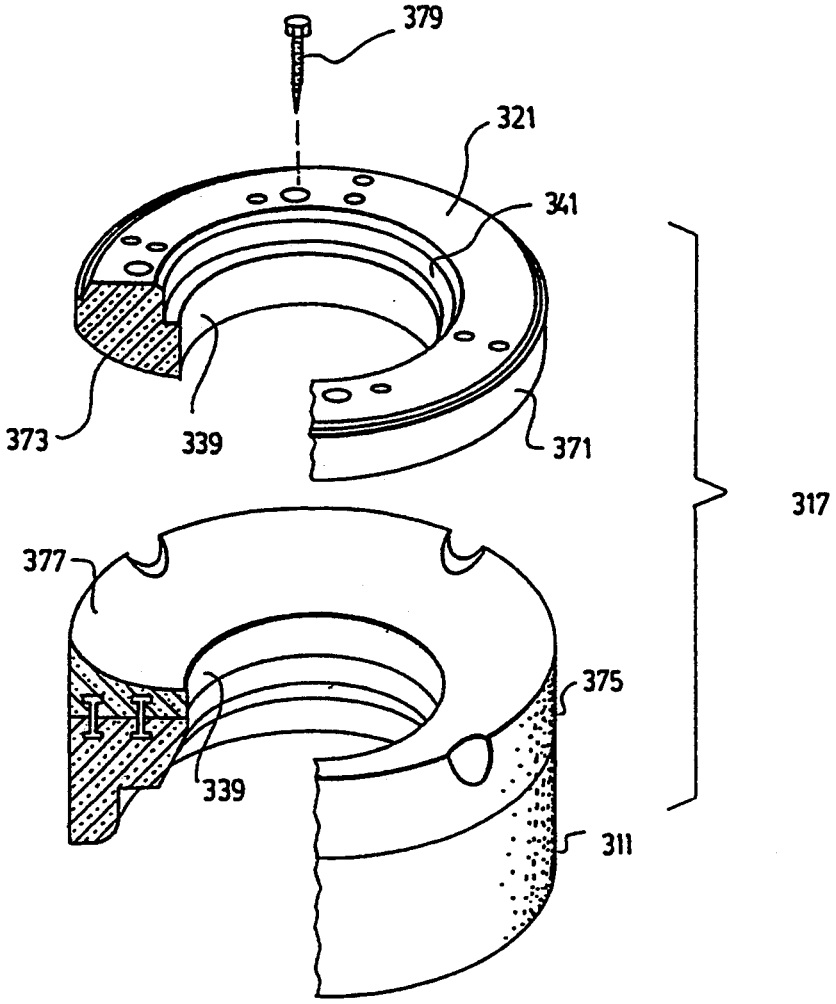
FIG. 9 is a partial exploded perspective view of a variant of an omni-directional manhole ring according to the invention.

The invention also relates to a variant of a manhole ring, as illustrated in FIG. 9, of the type provided with an inner wall 339 and an upper and a lower parts 321, 319, said ring 317 being intended to be mounted on a neighboring member "M" (which may be a ring "R") as illustrated in FIG. 1). This manhole ring 317 has its lower part 319 sized and shaped to be stacked on the upper part a member "M" (which may be a ring "R" as illustrated in FIG. 1).

The upper part 321 of the manhole ring 317 is provided with an inner wall and with an inner wall 339 and with a groove 341 appearing simultaneously in the upper part 321 and the inner wall 239 of said ring 317. The groove 341 is intended to define:

when associated with lateral and lower parts of a manhole cover identical to the manhole cover 223, means for receiving and positioning said manhole cover;

when associated with an annular sleeve projecting from the lower part of a neighboring upper ring positioned above and identical to the upper ring 217, means for the co-axial positioning of neighboring rings 317. The ring 317 has its upper part 321 substantially contained in a plane and provided with means allowing to move said upper part 321 so as to set that plane at an angle with respect to a plane orthogonal with the substantially vertical axis of the manhole ring 317. Means are also provided to lock that plane at such an angle.

Preferably, means for moving the plane in which the upper part 321 of the upper ring 317 is contained, may consist of:

an upper portion 371 having an upper part which corresponds to the upper part 321 of the upper ring 317, and a lower part 373, defining a sector of spherical surface, a lower portion 375, having a lower part which corresponds to the lower part 319 of the upper ring 317 and an upper part 377 defining a sector of spherical surface, both sectors of spherical surfaces having similar radius of curvature to allow one surface to slide freely on the other surface.

Preferably, the sector of spherical surface of the upper part 321 is convex and the sector of spherical surface of the lower part 375 is concave.

Preferably, means for locking the plane containing the upper part 321 of the upper portion 371 at a determined acute angle with respect to a plane orthogonal with the vertical axis of the manhole top ring 317, consist of one or several screws 379 each provided with a shoulder adapted to be engaged by the shoulder of a bore provided in the upper portion 371 so as to press the upper portion 371 against the lower portion 375 when said screw is driven in the lower portion 375.

The lower ring 311 and an lower portion 375 are fastened together in the same way than the lower ring 11 is fastened with an upper ring 17, and more particularly with tie-rod(s). Numeral references used in FIGS. 1 to 4 have been incremented by three hundreds in FIG. 8.

The use of the manhole ring illustrated in Figure has already been described hereinbefore and the use of the manhole ring illustrated in FIG. 9 is analogous to the use of the manhole ring of FIG. 8. Therefore, it is superfluous to further detail it.

The invention also relates to a method for adjusting the upper part 221 of the upper portion 271 of a manhole top ring 217 as defined hereinbefore, wherein the sector of spherical surface of the upper portion 271 is slid on the sector of spherical surface of the lower portion 275 until the plane containing the upper part of the upper portion 271 is substantially parallel with the surface of the roadway, and then both parts of the manhole ring are locked together with appropriated means, such as those defined above, for example.

The invention also relates to a method for adjusting the upper part 321 of the upper portion 371 of a manhole top ring 317 as defined hereinbefore, wherein the sector of spherical surface of the upper portion 371 is slid on the sector of spherical surface of the lower portion 375 until the plane containing the upper part of the upper portion 371 is substantially parallel with the surface of the roadway, and then both parts of the manhole ring are locked together with appropriated means, such as those defined above, for example.

Of course, the present invention also extend to all variations that could be obvious to a skilled workman.

What is claimed is:

1. A manhole head assembly having a substantially vertical axis and being mounted on a conventional manhole member made of non-elastic material, said head assembly comprising a stack of rings substantially co-axial with said vertical axis, the stack of rings including:

a lower ring made of non-elastic material and provided with a lower part and an upper part, the lower part being shaped to be stacked on an upper part of the conventional manhole member;

at least one upper ring made of resilient elastomeric material and each provided with a lower part and an upper part, the lower part of said upper ring being shaped to be stacked either on the upper part of the lower ring, or on the upper part of a neighboring upper ring positioned underneath;

means for fastening the lower part of the upper ring against the upper part of the lower ring, said fastening means including at least one tie-rod having opposite ends, each end being provided with at least one shoulder, one part of said tie-rod being positioned with its corresponding shoulder in the elastomeric material, the remaining part of said tie-rod being positioned with its corresponding shoulder in the non-elastic material;

means for fastening the lower part of any of another upper ring with the upper part of a neighboring upper ring positioned underneath, when there is more than one upper ring;

a manhole cover provided with a lower part, a lateral part, and an upper part; and means positioned in the upper part of an uppermost upper ring which is located at the top of the stack for receiving the lower part and the lateral part of the manhole cover while positioning the upper part of said manhole cover substantially flush with the upper part of the uppermost upper ring.

2. A manhole head assembly according to claim 1, wherein the non-elastic material is concrete and the resilient elastomeric material is rubber.

3. A manhole head assembly according to claim 2, wherein between each pair of neighboring upper rings there is further provided means allowing to co-axially position each ring along said vertical axis.

4. A manhole head assembly according to claim 3, wherein means for fastening the lower part of an upper ring with the upper part of a neighboring upper ring includes at least one nut-bolt assembly, each nut-bolt assembly comprising a nut and a bolt, the nut being provided with at least one shoulder positioned in the rubber of the upper ring positioned underneath so as to have one end thereof substantially flush with the upper part of said upper ring, the bolt being provided with a head defining a shoulder and housed in a corresponding bore provided across the upper ring that is positioned above, said bore being provided with a shoulder adapted to be engaged by the shoulder of the bolt when the bolt is engaged with its corresponding nut to thus press the lower part of the upper ring positioned above against the upper part of the upper ring positioned underneath.

5. A manhole head assembly according to claim 4, wherein at least one upper ring has an inner wall and is provided with a groove appearing simultaneously in the upper part and the inner wall of said upper ring, the groove being defined:

when associated with said lateral part and the lower part of the manhole cover, said means for receiving and positioning said manhole cover; and when associated with an annular sleeve concentrically projecting from the lower part of a neighboring upper ring positioned above, said means for the co-axial positioning of two neighboring upper rings.

6. A manhole head assembly according to claim 5, wherein between two neighboring upper rings, there is further provided:

a first spacer ring positioned between the upper part of the upper ring positioned underneath and the lower part of the upper ring positioned above; and a second spacer ring positioned between an upper part of the groove and a lower part of the sleeve.

7. A manhole head assembly according to claim 6, wherein said first and second spacers are made of resilient elastomeric material and respectively fastened with at least the upper part and the groove of the upper ring positioned underneath.

8. A manhole head assembly according to claim 7, wherein at least one upper ring has its lower and upper parts respectively contained in planes that are substantially orthogonal with said vertical axis.

9. A manhole head assembly according to claim 8, wherein at least one upper ring is provided with an upper part substantially contained in a plane that forms an angle with respect to a plane orthogonal with said vertical axis.

10. A manhole head assembly according to claim 7, wherein one upper ring has its upper part substantially contained in a plane and is provided with means allowing to move the plane at an angle with respect to a plane orthogonal with the substantially vertical axis of the manhole head, and means for locking the plane at such an angle, such that if there is at least one upper ring mounted above the upper ring, the upper rings are co-axial with an axis substantially orthogonal with the plane containing the upper part of the upper ring.

11. A manhole head assembly according to claim 10, wherein means for moving the plane in which the upper part of the upper ring is contained comprises:

an upper portion having an upper part which corresponds to the upper part of the upper ring, and a lower part defining a sector of spherical surface;

a lower portion having a lower part which corresponds to the lower part of the upper ring, and an upper part defining a sector of spherical surface; and both sectors of spherical surfaces having of similar radius of curvature to allow one surface to slide freely on the other surface.

12. A manhole head assembly according to claim 11, wherein the sector of spherical surface of the upper portion is convex and the sector of spherical surface of the lower portion is concave.

13. A manhole head assembly according to claim 12, wherein means for fastening the lower part of a upper ring with the upper part of a neighboring upper ring positioned underneath includes at least one nut-bolt assembly, each nut-bolt assembly comprising a nut and a bolt, the nut being provided with at least one shoulder positioned in the rubber of the upper ring positioned underneath so as to have one end thereof substantially flush with the upper part of said upper ring, the bolt being provided with a head defining a shoulder and housed in a corresponding bore provided across the lower part of the upper ring, said bore being provided with a shoulder adapted to be engaged by the shoulder of the bolt when this bolt is engaged with its corresponding nut to thus press the lower part of the upper ring against the upper part of the upper ring positioned underneath.

14. A manhole head assembly according to claim 13, wherein means for locking the plane containing the upper part of the upper portion at a determined angle with respect to a plane orthogonal with the vertical axis of the manhole head, includes at least one screw, each screw provided with a shoulder adapted to engage a corresponding shoulder provided in a bore of the upper portion when said screw is engaged in said bore and when said screw is driven in the rubber defining the lower portion.

15. A manhole ring, comprising:

a co-axial stack of a lower ring and an upper ring;

the lower ring being made of non-elastic material and provided with a lower part and an upper part, the lower part being shaped to be stacked on an upper part of a conventional manhole member;

the upper ring being made of resilient elastomeric material and provided with a lower part and an upper part, the lower part the upper ring being shaped to be stacked on the upper part of the lower ring;

means for fastening the lower part of the upper ring against the upper part of the lower ring, said means consisting of at least one tie-rod having opposite ends, each end being provided with at least one shoulder, one part of said tie-rod being positioned with its corresponding shoulder in the elastomeric material, the remaining part of said tie-rod being positioned with its corresponding shoulder in the non-elastic material;

said upper part being further provided with either means for receiving and positioning a manhole cover, or means for the coaxial positioning of neighboring rings; and said upper ring having the upper part substantially contained in a plane and provided with means allowing to move said upper part so as to set the plane at an angle with respect to a plane orthogonal with the axis of the manhole ring, and means for locking the plane at such an angle.

16. A manhole ring according to claim 15, wherein means for moving the plane in which the upper part of the upper ring is contained includes an upper part comprising:

an upper portion having an upper part which corresponds to the upper part of the upper ring, and a lower part defining a sector of spherical surface;

a lower portion having a lower part which corresponds to the lower part of the upper ring, and an upper part defining a sector of spherical surface; and both sectors of spherical surfaces having similar radius of curvature to allow one surface to slide freely on the other surface.

17. A manhole ring according to claim 16, wherein the sector of spherical surface of the upper portion is convex and the sector of spherical surface of the lower portion is concave.

18. A manhole ring according to claim 17, wherein means for locking the plane containing the upper part of the upper ring at a determined angle with respect to a plane orthogonal with the vertical axis of the manhole ring, includes at least one screw, each screw provided with a shoulder adapted to engage a corresponding shoulder provided in a bore of the upper portion when said screw is engaged inside said bore and is driven in the lower portion.

19. A method for adjusting the upper part of a manhole ring as defined in claim 18, comprising the steps of:

sliding the sector of spherical surface of the upper portion on the sector of spherical surface of the lower portion until the plane containing the upper part of the upper ring is substantially parallel with the surface of a roadway; and locking the lower part and the upper part of the manhole ring together with appropriated means.

20. A manhole ring according to claim 18, wherein the non-elastic material is concrete.

21. A method for adjusting the upper part of a manhole ring as defined in claim 20, comprising the steps of:

sliding the sector of spherical surface of the upper portion on the sector of spherical surface of the lower portion until the plane containing the upper part of the upper ring is substantially parallel with the surface of a roadway; and locking the lower part and the upper part of the manhole ring together with appropriated means.

22. A manhole ring according to claim 20, wherein the resilient elastomeric material is rubber.

23. A method for adjusting the upper part of a manhole ring as defined in claim 22, comprising the steps of:

sliding the sector of spherical surface of the upper portion on the sector of spherical surface of the lower portion until the plane containing the upper part of the upper ring is substantially parallel with the surface of a roadway; and P1 locking the lower part and the upper part of the manhole ring together with appropriated means.

* * * * *